US007348925B2

(12) United States Patent
Noro et al.

(10) Patent No.: US 7,348,925 B2
(45) Date of Patent: Mar. 25, 2008

(54) ANTENNA UNIT AND FEEDING COMPONENT

(75) Inventors: Junichi Noro, Akita (JP); Kyuichi Sato, Akita (JP); Nobuaki Monma, Akita (JP); Shozo Miyamoto, Akita (JP); Takumi Suzuki, Akita (JP)

(73) Assignee: Mitsumi Electric Co., Ltd., Tama-shi (JP)

( * ) Notice: Subject to any disclaimer, the term of this patent is extended or adjusted under 35 U.S.C. 154(b) by 224 days.

(21) Appl. No.: 11/320,081

(22) Filed: Dec. 28, 2005

(65) Prior Publication Data

US 2006/0214851 A1 Sep. 28, 2006

(30) Foreign Application Priority Data

Mar. 28, 2005 (JP) ..... 2005-091304

(51) Int. Cl.
*H01Q 1/38* (2006.01)

(52) U.S. Cl. ..... 343/700 MS; 343/846

(58) Field of Classification Search ..... 343/700 MS, 343/702, 829, 846, 848
See application file for complete search history.

(56) References Cited

U.S. PATENT DOCUMENTS 5,181,044 A * 1/1993 Matsumoto et al. ..... 343/752
5,912,647 A * 6/1999 Tsuru et al. ..... 343/700 MS
6,469,673 B2 * 10/2002 Kaiponen ..... 343/703
6,567,047 B2 * 5/2003 Kuck ..... 343/700 MS
6,879,288 B2 * 4/2005 Byrne et al. ..... 343/700 MS
6,982,673 B2 * 1/2006 Yuanzhu ..... 343/700 MS
7,123,197 B2 * 10/2006 Suzuki ..... 343/702

FOREIGN PATENT DOCUMENTS

JP 2005-020644 A 1/2005

* cited by examiner

*Primary Examiner*—Tho Phan
(74) *Attorney, Agent, or Firm*—Frishauf, Holtz, Goodman & Chick, P.C.

(57) ABSTRACT

An antenna unit includes a feeding component 40 and a metal plate 50 on which the feeding component 40 is mounted. The feeding component 40 has an attaching member 43 made of resin to support a feeding line against the metal plate. The metal plate 50 has a pair of cut and raised parts 51 at both ends thereof while the attaching member 43 has a pair of locking hooks 432 at both ends thereof. The locking hooks are partly inserted into the cut and raised parts and thereby the feeding component is attached to the metal plate without projecting any parts of the attaching member from a rear surface of the metal plate.

4 Claims, 7 Drawing Sheets

ANTENNA UNIT AND FEEDING COMPONENT

This application claims priority to prior application JP 2005-91304, the disclosure of which is incorporated herein by reference.

BACKGROUND OF THE INVENTION

This invention relates to an antenna unit and a feeding component included therein, particularly, to a satellite signal receiving antenna unit for receiving a circular polarized wave such as a satellite radio broadcast.

A GPS (Global Positioning System) receiving antenna is currently known as an example of an antenna for receiving a radio wave from an artificial satellite. As the GPS receiving antenna, what is called a patch antenna is used, for example. The patch antenna has a ceramic board, which is an insulating material, with a pair of main surfaces. On one of the main surfaces of the ceramic board, a ground electrode is provided. On the other of the main surfaces of the ceramic board, a receiving electrode and a feeding pin are provided. The feeding pin is used for supplying a receiving signal to an external circuit.

Recently, it is propelled to execute a radio broadcast and so on using a circular polarized wave transmitted from the artificial satellite. To receive the radio broadcast, what is called a satellite radio broadcast receiving antenna is used.

The satellite radio broadcast receiving antenna includes a feeding component and a metal plate (or a ground electrode) on which the feeding component is mounted. The feeding component includes a feeding line and an attaching member for supporting the feeding line against the metal plate.

The attaching member has a pair of fixing tongues which has locking hooks and protrudes downward. On the other hand, the metal plate provides a pair of locking aperture to partly receive the fixing tongues. When the attaching member is mounted on the metal plate, the fixing tongues are partly inserted in the locking aperture and the locking hooks engage with edges defining the locking apertures. As a result, the attaching member is fixed to the metal plate. In this time, the locking hooks are projected downward from a rear surface of the metal plate.

The feeding component is connected to a circuit board which is placed on the rear surface of the metal plate. To miniaturize the antenna unit, it is desirable that the circuit board is located to be close to the rear surface of the metal plate. However, as mentioned above, the locking hooks of the attaching element are projected from the rear surface of the metal plate. Accordingly, it is necessary to locate the circuit board to avoid collision with the locking hooks projected from the rear surface of the metal plate. Therefore, the satellite radio broadcast receiving antenna has a problem that the circuit board has limited shape and its mounting area is small.

SUMMARY OF THE INVENTION

It is therefore an object of this invention to provide a feeding component having an attaching member which can be attached to a metal plate without projecting any parts thereof.

Another object of this invention is to provide an antenna unit having the feeding component mentioned above.

Other objects of this invention will become clear as the description proceeds.

According to an aspect of this invention, an antenna unit comprises a first metal plate which serves as a ground electrode and which has a main surface, a rear surface and a pair of cut and raised parts raised from the main surface at both ends of the first metal plate. A second metal plate is opposite to the main surface of the first metal plate. A feeding component is mounted on the main surface of the first metal plate and has a wire and an attaching member made of resin. The attaching member supports the wire against the first metal plate. The attaching member has a pair of engaging parts at both ends thereof. The engaging parts are engaged with the cut and raised parts to attach the attaching member to the first metal plate without projecting of any parts of the attaching member from the rear surface of the first metal plate.

In the antenna unit, the engaging parts may comprise a pair of locking hooks partly inserted into said cut and raised parts. Alternatively, on the condition the cut and raised parts have catches facing each other, the engaging parts may provide hollows for receiving the catches. Furthermore, on the same condition mentioned above, the engaging parts may provide a pair of steps for engaging with the catches.

According to another aspect of this invention, a feeding component is for mounted on a main surface of a metal plate having a pair of cut and raised parts raised from the main surface at both ends of the metal plate. The feeding component comprises a wire and an attaching member made of resin. The attaching member is for supporting the wire against the metal plate. The attaching member has a pair of engaging parts at both ends thereof. The engaging parts are engaged with the cut and raised parts without projecting from a rear surface of the metal plate.

In the antenna unit, the engaging parts may comprise a pair of locking hooks which can be partly inserted into the cut and raised parts. Alternatively, on the condition that the cut and raised parts have catches facing each other, the engaging parts may provide a pair of hollows which can receive the catches. Furthermore, on the same condition mentioned above, the engaging parts may provide a pair of steps which can engage with the catches.

DESCRIPTION OF THE PREFERRED EMBODIMENTS

Figure 1:
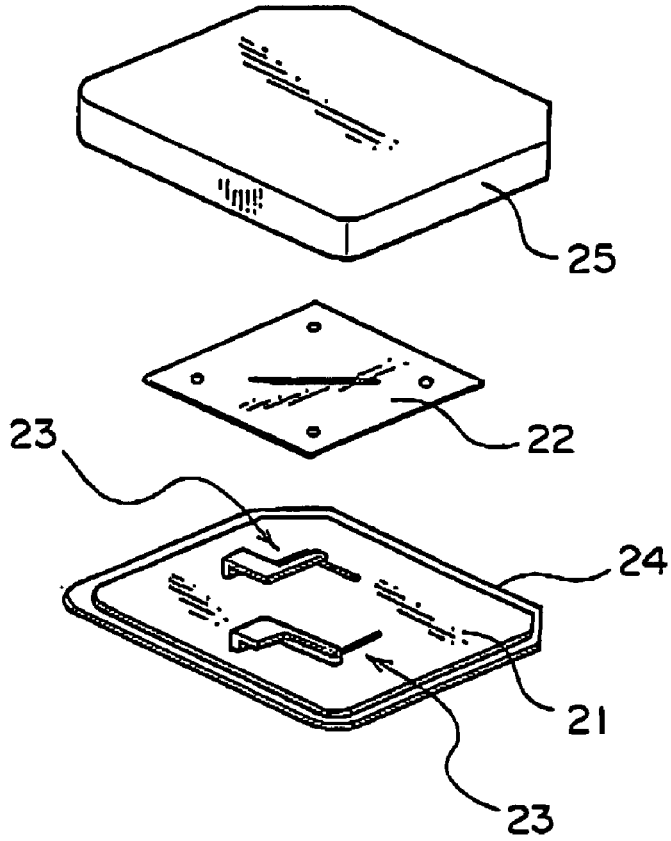
FIG. 1 PRIOR ART
FIG. 1 is an exploded perspective view showing an example of a conventional satellite signal receiving antenna unit.
Figure 2:
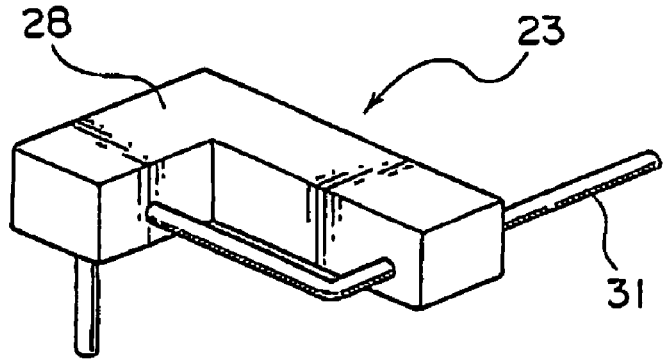
FIG. 2 PRIOR ART
FIG. 2 is an oblique perspective view showing an example of a conventional feeding component.

Referring to FIGS. 1 and 2, a description will be first directed to a conventional satellite radio broadcast receiving antenna unit.

In FIG. 1, the conventional satellite radio broadcast receiving antenna unit has a first metal plate 21 as a ground electrode, a second metal plate 22 which maintain a predetermined distance from the first metal plate 21 to be opposite thereto and which serves as a signal receiving surface, a pair of feeding components 23 disposed in a space between the first and the second metal plates 21 and 22 to feed the second metal plate 22.

The first metal plate 21 is made of metal material and shaped into a rectangular flat plate. The first metal plate 21 is attached to a lower cover 24. On the other hand, the second metal plate 22 is made of metal material and attached to an upper cover 25. The lower cover 24 and the upper cover 25 are assembled to form an internal space which contains the first metal plate 21, the pair of the feeding components 23 and the second metal plate 22.

As illustrated in FIG. 2, each of the feeding components 23 consists of a feeding line 31 and an attaching member 28 which are integrated by insert molding. The feeding line 31 is made of conductive material such as metal and shaped into a wire. The attaching member 28 is made of resin material.

The feeding line 31 has a horizontal part which is supported by the attaching member 28 against a main surface of the first metal plate 21 to be apart from the first metal plate 21.

In the satellite radio broadcast receiving antenna having the structure mentioned above, the feeding components 23 are arranged so that their horizontal parts are perpendicular to each other and thereby good receiving characteristics are obtained regarding to both of right and left circular polarized waves. Accordingly, the feeding lines 31 of the feeding components 23 are attached to the attaching members 28 in symmetrical arrangement. In other words, two types of the feeding components 23 having symmetrical arrangements are necessary to assemble the satellite radio broadcast receiving antenna.

The insert molding, which is used for integrating the feeding line 31 with the attaching member 28, raises manufacturing cost of the satellite radio broadcast receiving antenna. Especially, in a case where two of the feeding components 23 having symmetrical arrangements are necessary to deal with the right and the left circular polarized waves, the insert molding further rises the manufacturing cost because two types of insert molding dies are necessary.

To solve the problems mentioned above, the applicants have already proposed a satellite signal receiving antenna unit which is made by a technique that either of the symmetrical feeding components 23 can be obtained by changing bending direction of a feeding line and thereby the manufacturing cost is considerably reduced. Such an antenna unit is disclosed in Unexamined Japanese Patent Application Publication (JP-A) No. 2005-20644.

Figure 3:
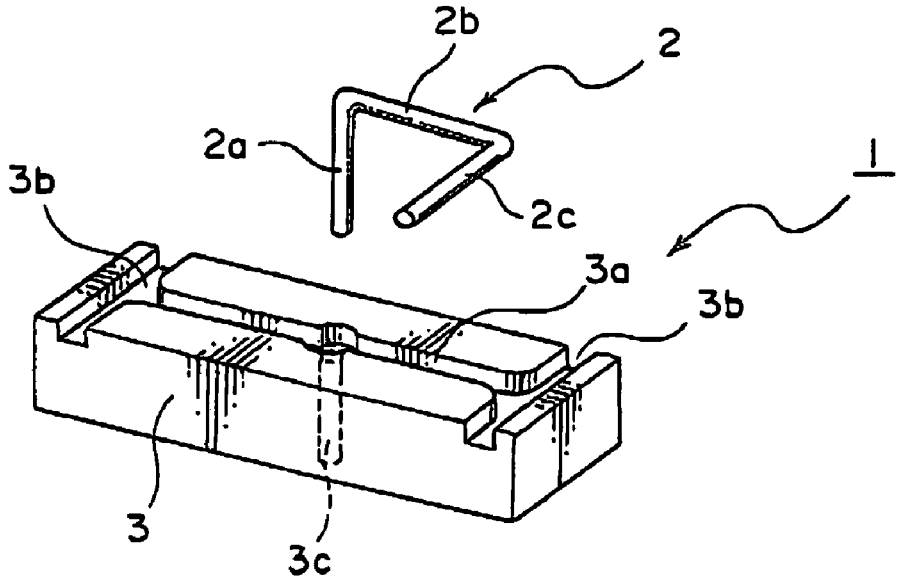
FIG. 3 PRIOR ART
FIG. 3 is an exploded perspective view showing another example of the conventional feeding component used in the conventional satellite signal receiving antenna unit.

FIG. 3 shows a feeding component used in the satellite signal receiving antenna unit disclosed in the above mentioned Publication. The feeding component 1 has a feeding line 2 made of metal and an attaching member 3 made of resin.

The feeding line 2 has a shape bent at two points on the square. Accordingly, the feeding line 2 has a base end portion 2*a* bent in a vertical direction, a supporting portion 2*b* continuing on the base end portion 2*a* and extending on a horizontal plane, and a feeding portion 2*c* bent at a right angle with the supporting portion 2*b* on the horizontal plane.

Figure 4:
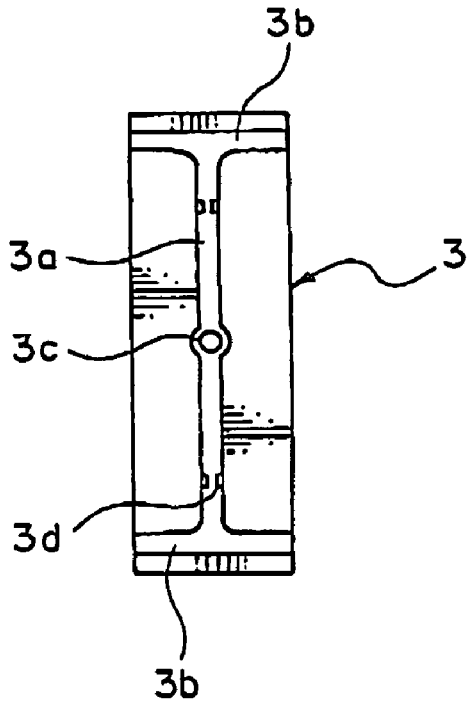
FIG. 4 PRIOR ART
FIG. 4 is a top plan view of an attaching member used for the feeding component shown in FIG. 3.

FIG. 4 is a top plane view of the attaching member 3. The attaching member 3 is a molding body having an almost rectangular parallelepiped shape. At the upper side of the attaching member 3, a first wire receiving groove 3*a* for receiving the supporting portion 2*b* of the feeding line 2 is formed along a longitudinal direction to stretch over almost total length of the attaching member 3. At the ends of the first wire receiving groove 3*a*, to correspond to the feeding portion 2*c* perpendicular to the supporting portion 2*b*, second wire receiving grooves 3*b* perpendicular to the first wire receiving groove 3*a* are formed along a width direction to stretch over total width of the attaching member 3. Here, to deal with the feeding portion 2*c* bent toward either of right and left hand directions regarding the supporting portion 2*b*, the second wire receiving grooves 3*b* are formed to stretch over total width of the attaching member 3. The wire receiving grooves 3*a* and 3*b* allow attaching either of the feeding lines 2 bent in the right and the left hand directions symmetrically to the attaching member 3.

At the middle of the first wire receiving groove 3*a*, a through hole 3*c* is bored through the attaching member 3 along the vertical direction. The through hole 3*c* is for receiving the base end portion 2*a* of the feeding line 2. The base end portion 2*a* inserted into the through hole 3*c* may be connected to a circuit board (not shown) to serve as an signal output electrode of the feeding line 2.

A plurality of tiny projections 3*d* is formed on inner walls defining the first wire receiving groove 3*a* of the attaching member 3. The tiny projections 3*d* press and hold the supporting portion 2*b* put into the first wire receiving groove 3*a* to prevent the supporting portion 2*b* of the feeding line 2 from falling away from the first wire receiving groove 3*a*. Thus, the tiny projections 3*d* allow the feeding line 2 to be fixed to the attaching member 3 without extra parts.

Figure 5A:
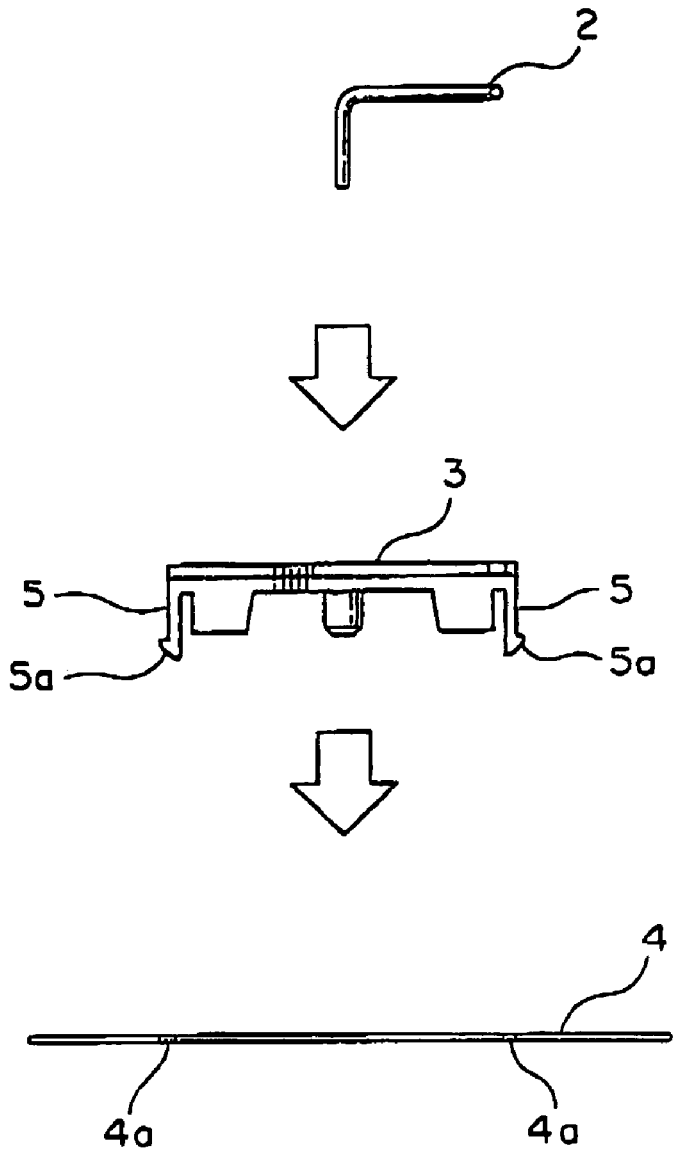
FIG. 5A PRIOR ART
FIG. 5A is an exploded lateral view showing a state previous to mounting of the conventional feeding component on a metal plate.
Figure 5B:
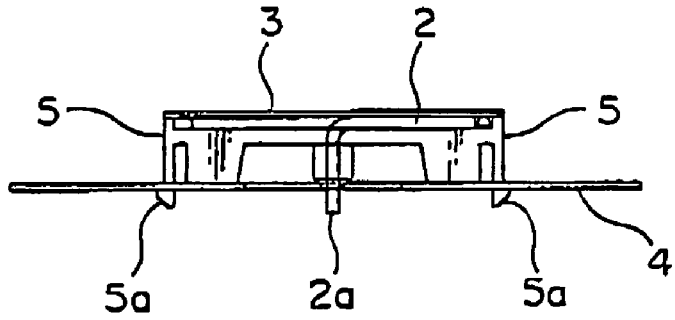
FIG. 5B PRIOR ART
FIG. 5B is a lateral view showing a state after the mounting of the conventional feeding component on the metal plate.

Referring to FIGS. 5A and 5B, the feeding component 1 consisting of the feeding line 2 and the attaching member 3 is mounted on a first metal plate 4 by the use of attaching slots or locking apertures 4*a* provided in the first metal plate 4. Specifically, the attaching member 3 has fixing tongues 5 at both ends thereof. Each of the fixing tongues 5 extends downward and has a locking hook 5*a* at a tip thereof. The fixing tongues 5 are made of resin and have a thin board shape. Therefore, the fixing tongues 5 are flexible to a certain degree. When the fixing tongues 5 are partly inserted into the locking apertures 4*a* as shown in FIG. 5B, the locking hooks 5*a* are engage with edges defining the locking apertures 4*a*. Thus, the fixing tongues 5 (i.e. the attaching member or the feeding component) are fixed to the first metal plate 4.

After the feeding component 1 is mounted on the fist metal plate 4, a circuit board (mentioned later) is located on a rear surface of the first metal plate 4. The base end portion 2*a* of the feeding line 2 is partially projected from the rear surface of the metal plate 4 and connected to the circuit board by solder.

Figure 6A:
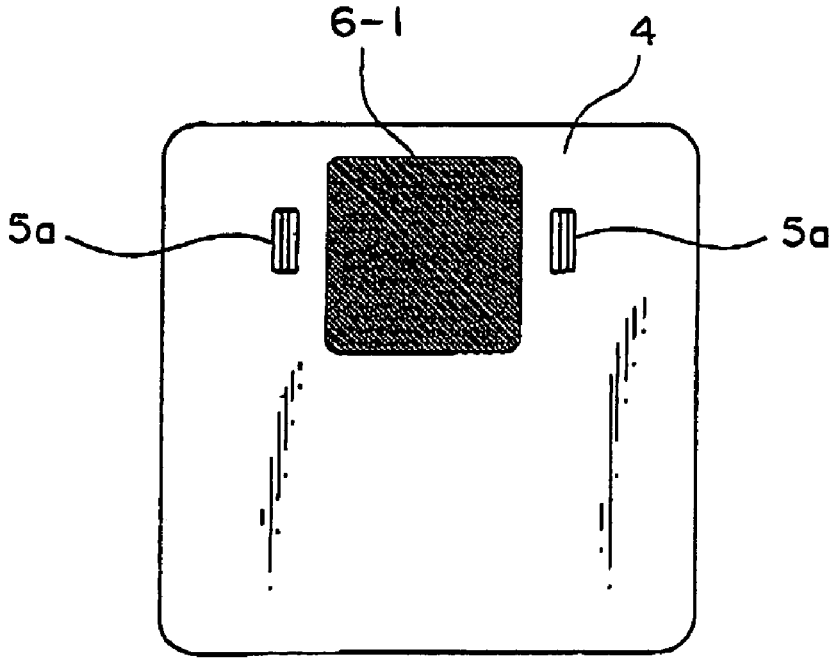
FIG. 6A PRIOR ART
FIG. 6A is a bottom plan view of the metal plate with a circuit board having size capable of being placed between locking hooks of the conventional feeing component.
Figure 6B:
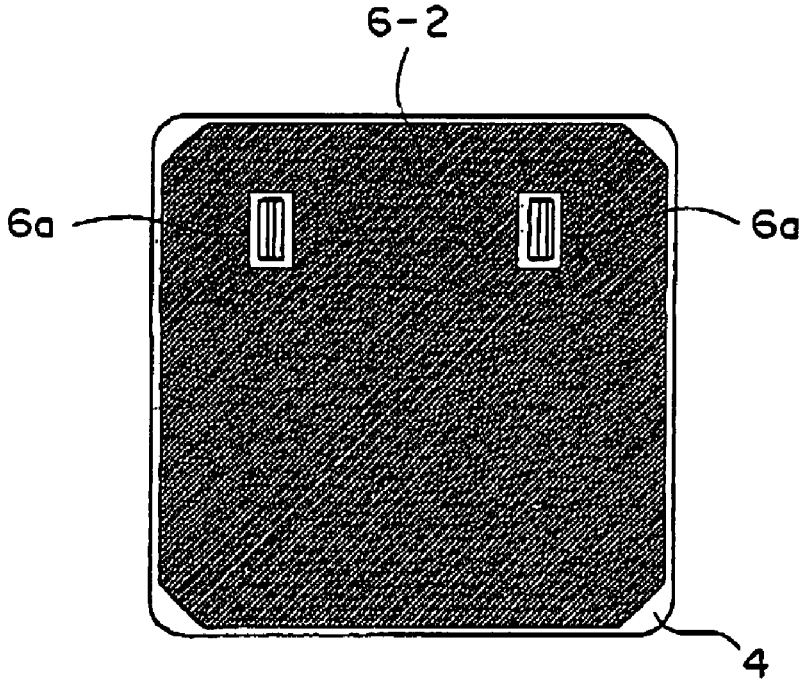
FIG. 6B PRIOR ART
FIG. 6B is a bottom plan view of the metal plate with another circuit board having openings or notches corresponding to the locking hooks of the conventional feeding component.

As mentioned above, the locking hooks 5*a* are projected from the rear surface of the first metal plate 4 as shown in FIG. 5B when the conventional feeding component 1 is mounted on the first metal plate 4. Consequently, the circuit board located on the rear surface of the first metal plate 4 needs to have size which allow being placed between the locking hooks 5*a* like a circuit board 6-1 illustrated in FIG. 6A. Alternatively, the circuit board needs to have a shape providing openings or notches for avoiding the locking hooks 5*a* like a circuit board 6-2 illustrated in FIG. 6B.

Thus, the feeding component 1 has a problem of limiting a mounting area of a circuit board.

Figure 7B:
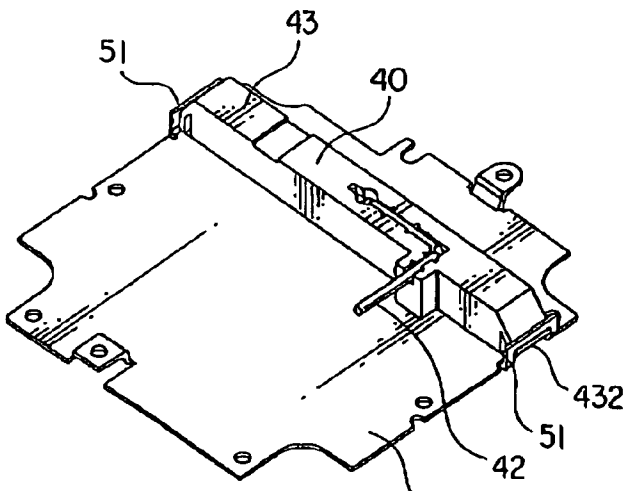
FIG. 7B is a perspective view of the feeding component and the first metal plate illustrated in FIG. 7A.
Figure 7A:
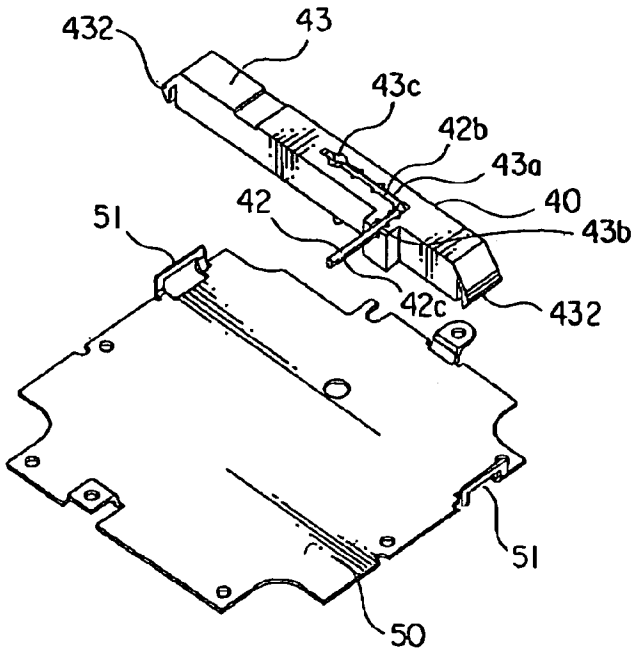
FIG. 7A is an exploded perspective view showing a feeding component and a first metal plate used in a satellite signal receiving antenna unit.
Figure 7C:
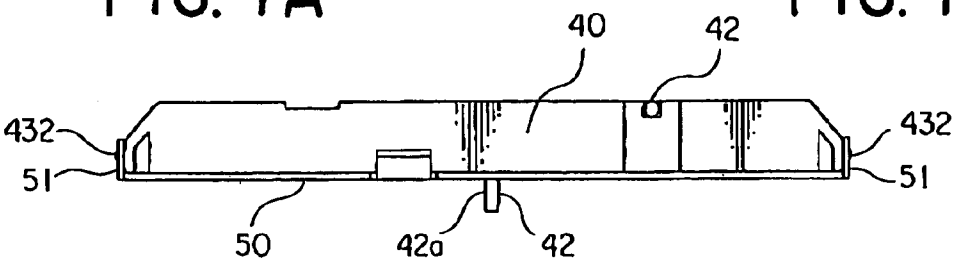
FIG. 7C is a front elevational view of the feeding component and the first metal plate illustrated in FIG. 7A.

Referring to FIGS. 7A to 7C, a description will be made of a feeding component 40 and a first metal plate 50 which are used in a satellite signal receiving antenna unit according to a first embodiment of this invention. The feeding component 40 and the first metal plat 50 may be used in the satellite signal receiving antenna unit as illustrated in FIG. 1 instead of the feeding component 32 and the first metal plate 21. The feeding component 40 is mounted on the main surface of the first metal plate 50.

The feeding component 40 has a feeding line (or a feeding probe) 42 made of metal and an attaching member 43 made of resin.

The feeding line 42 has a shape bent at two points on the square. Accordingly, the feeding line 42 has a base end portion 42*a* bent in a vertical direction, a supporting portion 42*b* continuing on the base end portion 42*a* and extending on a horizontal plane, and a feeding portion 42*c* bent at a right angle with the supporting portion 42*b* on the horizontal plane. The supporting portion 42*b* may be called a feeding portion together with the feeding portion 42*c*.

The attaching member 43 is a molding body having an almost rectangular parallelepiped shape. At the upper side of the attaching member 43, a first wire receiving groove 43*a* for receiving the supporting portion 42*b* of the feeding line 42 is formed along a longitudinal direction. At one of ends of the first wire receiving groove 43*a*, a second wire receiving groove 43*b* perpendicular to the first wire receiving groove 43*a* is formed to correspond to the feeding portion 42*c* perpendicular to the supporting portion 42*b*.

At the other end of the first wire receiving groove 43*a*, a through hole 43*c* is bored through the center of the attaching member 43 along the vertical direction. The through hole 43*c* is for receiving the base end portion 42*a* of the feeding line 42. The base end portion 42*a* inserted into the through hole 43*c* may be connected to a circuit board (not shown) to serve as an signal output electrode of the feeding line 42.

The first metal plate 50 has a pair of cut and raised parts 51 raised at a side of the attaching member 43 (or its main surface) at both ends. In other words, the cut and raised parts are raised from the main surface of the first metal plate 50. On the other hand, the attaching member 43 has locking hooks 432 at both ends thereof. The locking hooks 432 are partially insert into (or engage with) the cut and raised parts 51 without protruding from a rear surface of the first metal plate 50. At any rate, the locking hooks 432 serves as engaging means for engaging with the cut and raised parts.

Figure 8:
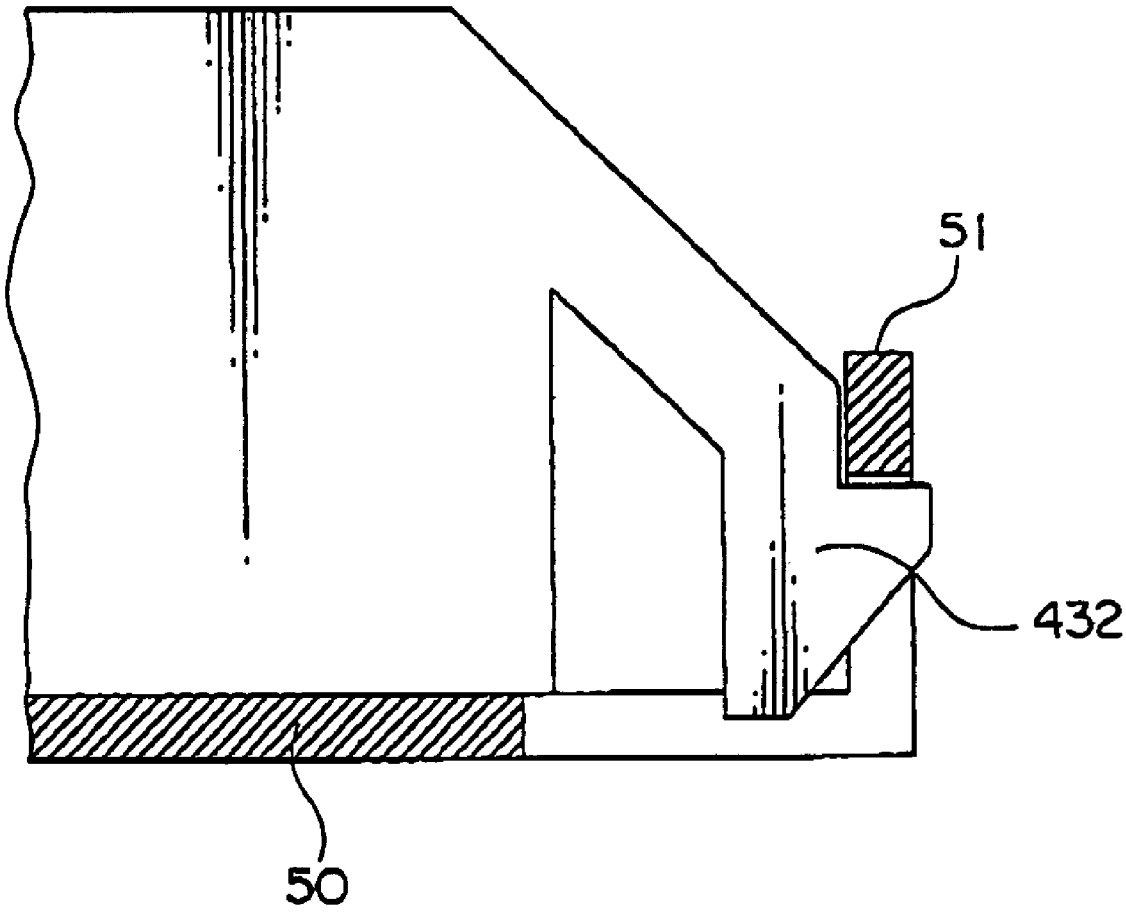
FIG. 8 is an enlarged sectional view showing a cut and raised part of the first metal plate and a locking hook of the feeding component illustrated in FIGS. 7A-7C.

FIG. 8 is an enlarged sectional view of the cut and raised part 51 of the first metal plate 50 and the locking hooks 432 of the feeding component 40.

Thus, the first metal plate 50 provides the cut and raised parts 51 to receive the feeding component 40 while the feeding component provides the locking hooks 432 locked to the cut and raised parts 51 at the position that the locking hooks 432 are not protrude from the rear surface of the first metal plate 50. Therefore, differently from the conventional satellite signal receiving antenna (see FIG. 5B) that the locking hooks 5*a* protrude from the rear surface of the first metal plate 4, the locking hooks 432 does not protrude from the rear surface of the first metal plate 50 when the feeding component 40 is mounted on the first metal plate 50.

According to the structure mentioned above, the rear surface of the first metal plate 50 is flat except for the base end portion 42*a*, which is connected to the circuit board by solder, of the feeding line 42. Thus, the feeding component 40 (or the attaching member 43) has no effect on the circuit board located on the rear surface of the first metal plate 50 regarding size, shape and/or mounting area.

Figure 9:
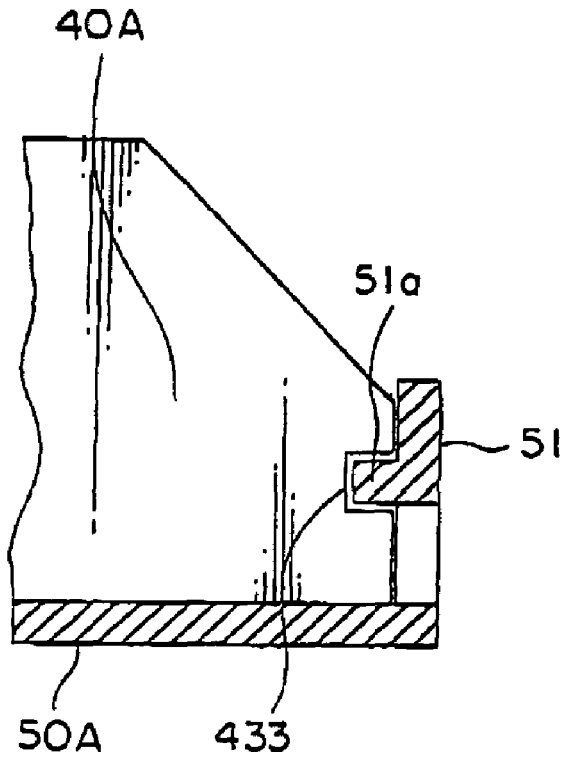
FIG. 9 is an enlarged fragmentary sectional view of a feeding component and a first metal plate used in a satellite signal receiving antenna unit according to a second embodiment of this invention.

Referring to FIG. 9, the description will be made about a feeding component 40A and a first metal plate 50A which are used in a satellite signal receiving antenna unit according to a second embodiment of this invention.

The first metal plate 50A has a pair of cut and raised parts 51 with catches 51*a* facing each other. On the other hand, the feeding component 40A provides hollows for receiving the catches 51*a*. That is, the feeding component 40A is similar to the feeding component 40 illustrated in FIGS. 7A-7C and 8 except for a point that it has the hollows 433 instead of the locking hooks 432.

The feeding component 40A is mounted on the first metal plate 50A by putting the catches 51*a* of the cut and raised parts 51 of the first metal plate 50A into the hollows 433 of the feeding component 40A.

Putting the catches 51*a* of the cut and raised parts 51 into the hollows 433 may be implemented by elastic deformation of the cut and raised parts 51 to which flexibility is given. Alternatively, the putting may be made by sliding the attaching member 43 on the first metal plate 21 before the feeding line 42 is attached to the attaching member 43.

According to the structure mentioned above, the rear surface of the first metal plate 50A is flat except for the base end portion 42*a* of the feeding line 42 of the feeding component 40A. Thus, the feeding component 40A has no effect on the circuit board located on the rear surface of the first metal plate 50A regarding size, shape and/or mounting area.

Figure 10:
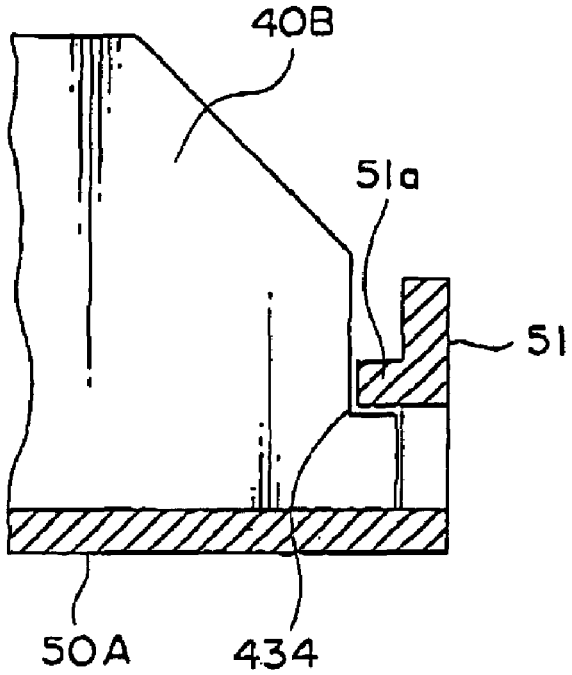
FIG. 10 is an enlarged fragmentary sectional view of a feeding component and a first metal plate used in a satellite signal receiving antenna unit according to a third embodiment of this invention.

Referring to FIG. 10, the description will be made about a feeding component 40B used in a satellite signal receiving antenna unit according to a third embodiment of this invention. The feeding component 40B is similar to the feeding component 40A illustrated in FIG. 9 except for a point that it has steps 434 instead of the hollows 433.

The feeding component 40B is mounted on the first metal plate 50A by engaging the catches 51*a* of the cut and raised parts 51 of the first metal plate 50A with the steps 434 of the feeding component 40B.

Engaging the cut and raised parts 51 with the steps 434 may be implemented by elastic deformation of the cut and raised parts 51 to which flexibility is given. Alternatively, the engaging may be made by sliding the attaching member 43 on the first metal plate 21 before the feeding line 42 is attached to the attaching member 43.

According to the structure mentioned above, the rear surface of the first metal plate 50A is flat except for the base end portion 42*a* of the feeding line 42 of the feeding component 40B. Thus, the feeding component 40B has no effect on the circuit board located on the rear surface of the first metal plate 50A regarding size, shape and/or mounting area.

While this invention has thus far been described in conjunction with the preferred embodiments thereof, it will readily be possible for those skilled in the art to put this invention into practice in various other manners. For example, the engaging means are not limited to the locking hooks, hollows or steps mentioned above.

What is claimed is:

1. An antenna unit comprising:

a first metal plate serving as a ground electrode and having a main surface, a rear surface and a pair of cut and raised parts raised from said main surface at both ends of said first metal plate;

a second metal plate opposite to said main surface of said first metal plate; and a feeding component mounted on said main surface of said first metal plate and having a wire and an attaching member made of resin, said attaching member supporting said wire against said first metal plate, wherein said attaching member has, at both ends thereof, a pair of engaging parts engaged with said cut and raised parts for attaching said attaching member to said first metal plate without projecting of any parts of said attaching member from said rear surface of said first metal plate.

2. An antenna unit as claimed in claim 1, wherein said engaging parts comprise a pair of locking hooks partly inserted into said cut and raised parts.

3. An antenna unit as claimed in claim 1, wherein said cut and raised parts have catches facing each other, and wherein said engaging parts provide a pair of hollows receiving said catches.

4. An antenna unit as claimed in claim 1, wherein said cut and raised parts have catches facing each other, and wherein said engaging parts provide a pair of steps engaging with said catches.

* * * * *